US009498970B2

(12) United States Patent
Carnelli et al.

(10) Patent No.: US 9,498,970 B2
(45) Date of Patent: Nov. 22, 2016

(54) SYSTEM AND METHOD FOR MONITORING INK USE IN A PRINTING SYSTEM

(71) Applicant: QuadTech, Inc., Sussex, WI (US)

(72) Inventors: Carlo Carnelli, Saronno (IT); John Seymour, Milwaukee, WI (US); Michael Sisco, Waukesha, WI (US)

(73) Assignee: QuadTech, Inc., Sussex, WI (US)

( * ) Notice: Subject to any disclaimer, the term of this patent is extended or adjusted under 35 U.S.C. 154(b) by 0 days.

(21) Appl. No.: 14/621,064

(22) Filed: Feb. 12, 2015

(65) Prior Publication Data

US 2016/0236478 A1 Aug. 18, 2016

(51) Int. Cl.
*B41J 2/175* (2006.01)

(52) U.S. Cl.
CPC ..... *B41J 2/17566* (2013.01)

(58) Field of Classification Search
None
See application file for complete search history.

(56) References Cited

U.S. PATENT DOCUMENTS

| | | | | |
|---|---|---|---|---|
| 6,142,078 | A * | 11/2000 | Lachajewski | B41F 33/0045 101/211 |
| 6,389,968 | B1 * | 5/2002 | Sugimoto | B41F 33/0045 101/211 |
| 7,298,519 | B2 * | 11/2007 | Silverbrook | B41J 2/0452 358/1.16 |
| 2002/0140748 | A1 * | 10/2002 | Kanaya | B41J 2/17566 347/7 |
| 2006/0276978 | A1 | 12/2006 | Yamamoto et al. | |
| 2008/0111842 | A1 | 5/2008 | Hall et al. | |
| 2009/0244125 | A1 * | 10/2009 | Ozaki | B41F 33/00 347/9 |
| 2012/0249626 | A1 | 10/2012 | Asada | |
| 2013/0128286 | A1 | 5/2013 | Tamagawa | |
| 2014/0085363 | A1 | 3/2014 | Van Brocklin et al. | |

* cited by examiner

*Primary Examiner* — Bradley Thies
(74) *Attorney, Agent, or Firm* — Boyle Fredrickson, S.C.

(57) ABSTRACT

A computer-implemented system for determining ink availability in one or more ink reservoirs in a print system is described. The system includes at least one ink reservoir for each color ink used in the printing system, a print unit associated with each ink reservoir configured to apply a print image including at least one color of ink to a substrate based on print image information, and an ink level monitoring system configured to determine an ink availability in each ink reservoir based on printed image count information and a total wet ink utilization based on a measured dry ink utilization per area of coverage using the print image information and corrected by an ink usage correction multiplier generated based on characterization of a print condition.

11 Claims, 5 Drawing Sheets

SYSTEM AND METHOD FOR MONITORING INK USE IN A PRINTING SYSTEM

FIELD

The present application generally relates to an apparatus, system and method for tracking ink usage in a printing operation. More particularly, the present application relates to an apparatus, a system, and a method for tracking ink usage in a printing operation based on printed material information.

BACKGROUND

A printing operation generates printed material by applying ink to a type of substrate using any of a variety of different methods. In huge printing operations, the operation may be used to produce a large amount of punted material. For example, in rotogavure printing presses, a substrate such as a web of paper or film is sequentially driven through a series of engraved cylinders, each using ink of a different color, which cooperate to imprint a multicolor image on the web. Using this method, each cylinder has its own supply of a single color of ink. The amount of ink that is used for each cylinder is usually different from any other cylinder and is dependent on the image being applied to the web, the thickness of the ink, the coverage level, etc. Tracking ink usage and availability is important since a printing operation relies on having constant availability of a variety of different colors of inks that are often used in differing amounts and/or at differing rates.

Printing operations rely on having availability of ink having a consistent color and other characteristics to produce printed material with a correct and consistent appearance. During a print operation, adjustments to the formulation of an ink may be necessary in order to maintain this correct and consistent appearance. For example, it may be determined that a small amount of red pigment or extender (unpigmented ink) should be added. However, in order to calculate how much of an ingredient to add, it is important to know not only the characteristics of the ink being added to a reservoir and the ink already in the reservoir, but also the amount of ink remaining in the reservoir and in the system at any given time.

In some systems for ink measurement, ink levels in the reservoirs may be monitored by metering devices in the ink lines and/or by scales monitoring the weight or mass of the reservoir holding the ink. For example, the weight monitoring method includes determining the amount of ink that has been used by successive weighing of the ink reservoir. This method has also been used in combination with pump stroke measurement, a type of metering device, to refine the ink level calculation.

However, both methods have known drawbacks. For example, metering devices may not be usable in certain types of printing methods such a rotogravure printing press where the ink is constantly recirculated and applied by immersion of the engraved cylinder rather than pumped. Further, meters may be inaccurate since a member of different factors can cause actual ink consumption to vary from meter measurement values. The factors can include the variability of the volume of ink displaced with each pump stroke and backflow of the ink in the pump. These depend on the specific gravity, viscosity and tackiness of the ink as well as the age and wear of the pump. A number of these problems can be avoided by using ink, weighing to determine the amount of ink in a reservoir, but this method requires additional steps such as scale calibration, scale maintenance, methods for recognizing outlier weightings, such as during a filling/exchange operation, etc. A weighing operation may further cause unavailability of the reservoir during weighing. Further, both metering devices and ink weighing scales are additional components that must be purchased, maintained and upgraded, increasing the cost of the printing operation.

Accordingly, it is desirable to provide a system and method for monitoring the consumption of ink without utilizing metering devices and/or ink weighing. What is further needed is such a system and method configured to facilitate color correction calculations based on the monitored ink consumption.

SUMMARY

Provided is a system and method for tracking ink levels in a large scale print system based on printed image information and printed image count. The printed image information may be a theoretical value and/or a detected value representing the amount of ink used for each printed image. This system and method provides an advantage over systems using a weighing scale by avoiding the additional equipment, manpower and workflow interruptions typically associated with each weighing. This system also provides an advantage over metered pumps that may be inaccurate based on a variety of factors such as variable ink density.

In one embodiment, a computer-implemented system for determining ink availability in one or more ink reservoirs in a print system is described. The system includes at least one ink reservoir for each color ink used in the printing system, a print unit associated with each ink reservoir configured to apply a pint image including at least one color of ink to a substrate based on print image information, and an ink level monitoring system configured to determine an ink availability in each ink reservoir based on printed image count information and a total wet ink utilization based on a measured dry ink utilization per area of coverage using the print image information and corrected by an ink usage correction multiplier generated based on characterization of a print condition.

According to specific alternatives, the print image is applied to a substrate by a print unit of the printing system. In this case, determining printed image count information can include determining the number of instances of the print image applied to the substrate and determining the number of instances of the print image applied to the substrate includes for example using an impression counting device. The method can further include receiving an initial wet ink reservoir ink amount and decreasing the wet ink amount by the image ink utilization for each print image in the printed image count information to determine a current ink reservoir amount. The method may also include detecting deviations from the print image information using a color measuring device for measuring colorimetric or spectrophotometric properties of an applied print image and correcting the image ink utilization based on the detected deviation and/or determining an amount of an ink color correction agent to add to an ink reservoir based on the detected deviation and the current ink reservoir amount. Following the addition of the agent, the current wet ink reservoir amount is modified based on the amount of the ink color correction agent.

In another embodiment, a computer-implemented method for determining ink utilization in a printing system is described. The method includes receiving a characterization, of a print condition to determine dry ink utilization per area of coverage at a printing system computer, applying an ink usage correction multiplier to determine wet ink utilization based on the dry ink utilization to generate corrected image ink utilization, determining an area of coverage for a given printed image, determining printed image count information, and determining total wet ink utilization based on the area of coverage, the corrected image ink utilization and the printed image count information.

In yet another embodiment, a computer-implemented system for determining ink utilization in a printing system is described. The system includes an ink monitoring computer including a processor and non-transient memory including instruction store thereon to determine ink utilization in an ink reservoir based on receiving a characterization of a print condition to determine dry ink utilization per area of coverage at a printing system computer, applying an ink usage correction multiplier to determine wet ink utilization based on the dry ink utilization to generate corrected image ink utilization, determining an area of coverage for a given printed image, determining printed image count information, and determining total wet ink utilization based on the area of coverage, the corrected image ink utilization and the printed image count information.

BRIEF DESCRIPTION OF THE DRAWINGS

Preferred exemplary embodiments are illustrated in the accompanying drawings in which like reference numerals represent like parts throughout.

In the drawings.

Figure 1A:
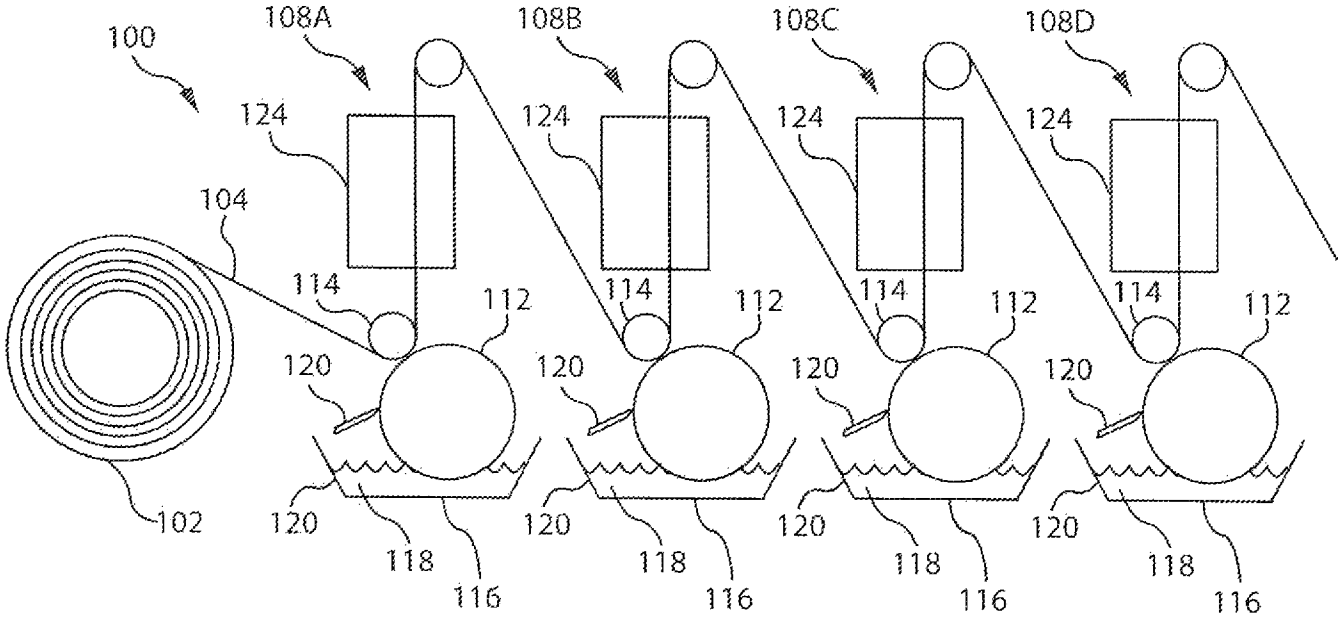
FIGS. 1A and 1B are depictions of a type of conventional printing press system for printing a multi-color image on a substrate, according to an exemplary embodiment.

Before one embodiment is described in detail, it is to be understood that the system and method is not limited in its application to the details of construction and the arrangement of components set forth in the following description or illustrated in the drawings. The system and method described herein is capable of other embodiments and of being practiced or of being carried out in various ways. Also, it is to be understood that the phraseology and terminology used herein is for the purpose of description and should not be regarded as limiting.

DETAILED DESCRIPTION

Referring to FIG. 1A, one type of press system 100, specifically a four-color, single-sided gravure press, is illustrated. The press system 100 includes a substrate roll 102 feeding a substrate web 104 into a first print unit 108A. The first print unit 108A includes a gravure cylinder 112 rotating in an ink fountain 116 where ink 118 fills engraved cells in the cylinder 112. More specifically, each of the cells on the cylinder 112 comes directly into contact with the ink 118 in the first gravure print unit 108A. In this stage of the revolution of the cylinder 112, the cells will be filled with the ink/solvent mixture 118 to be transferred to the web 104.

A doctor blade 120 scrapes the surface of cylinder 112 such that only ink residing in the engraved cells is available to the web 104 in the printing process. The doctor blade 120 removes any excess mixture so that the cells store precisely the required amount of mixture 118 when the cylinder 112 is in contact with the web 104.

Next, the substrate web 104 gets sandwiched between an impression roller 114 and the gravure cylinder 112 where the ink gets transferred from the engraved cells to the web 104. The web 104 proceeds from the gravure cylinder 112 to a dryer unit 124, where the ink 118 on the web 104 is dried.

This process is repeated for each of the three other illustrated print units 108B, 108C and 108D. In a typical operation cyan, magenta, yellow, and black inks are sequentially applied. However, it is understood that any colors of ink may be utilized by the present system. The location of the printing units 108A-D relative to each other is determined by the printer, and may vary. Further, more or less print units 108 may be utilized. For example, the inks cyan, magenta, yellow, and black may be augmented so as to match special colors for corporate logos, or by additional colors of inks such as orange, green, and violet so as to be able to mix multiple inks to get a wider color gamut. Alternatively, fewer units 108 may be utilized, such as for grayscale printing or other single color printing.

In the illustrated embodiment, the press system 100 is a rotogravure press. It is contemplated, however, that the present system and method be applicable to other types of printing presses, such as flexographic and web offset presses. Further in the illustrated embodiment, the substrate is shown and described as web 104, but it is also contemplated that the substrate may be, for example, individual sheets as delivered by a sheet fed press. It is further contemplated that the substrate may be opaque, transparent, partially transparent, translucent, etc. and/or may have one or more portions having these properties.

Figure 1B:
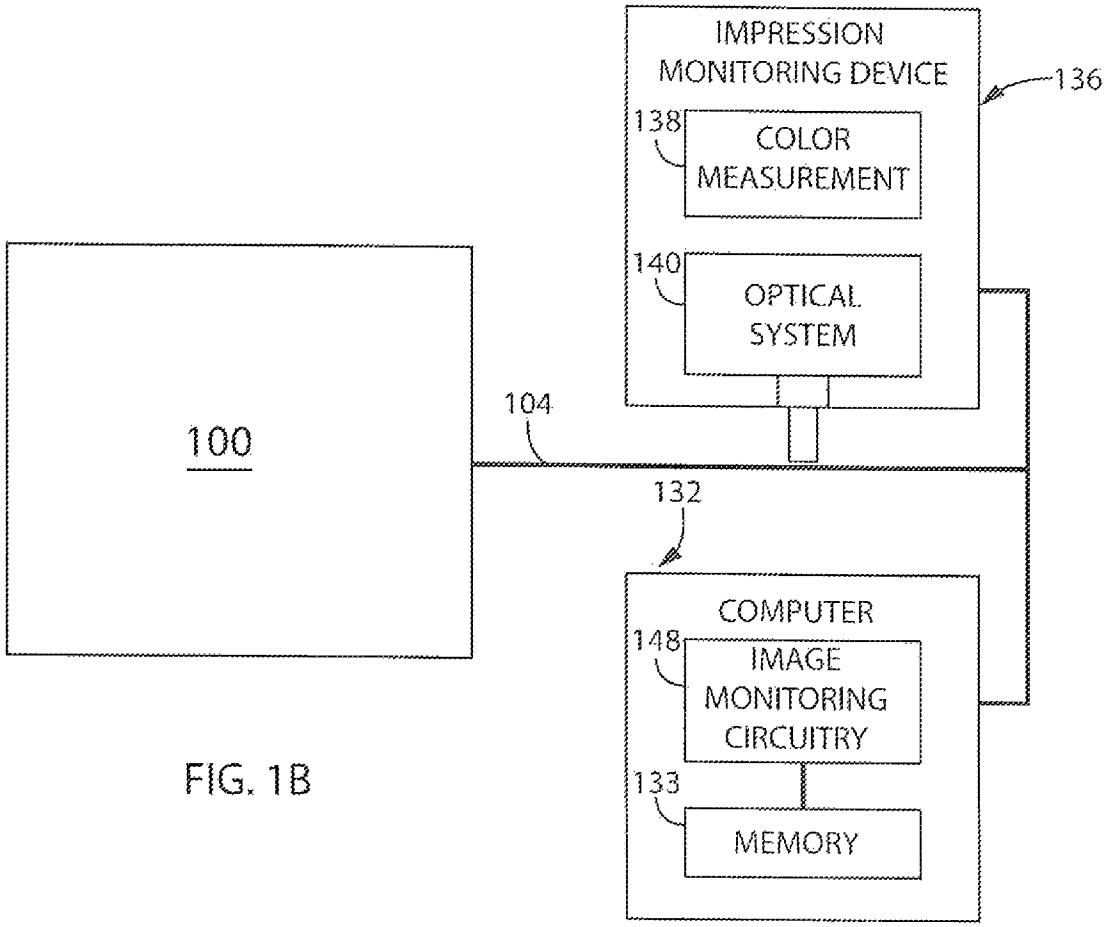

Referring now to FIG. 1B, the press system 100 may further include an impression counting device 136. This device may, for example, be an encoder (not shown) operatively connected to a drive shaft, a roller, or directly to the web so as to provide a number which can be converted to linear feet or any other suitable unit of length measurement. Alternatively, the press system 100 may include an impression counting device 136 including an optical system 140 which tracks fiducial marks on the web, control patches, or the printed work so as to count impressions.

System 100 may also include a color measurement device 138. The color measurement device 138 may be for example, a colorimeter, spectrophotometer, densitometer. RGB device, etc. which operates so as to make measurements of the color of portions of the print image on web 104. Color measurement device 138 may be inline, which is to say, mounted directly to the press system 100 so as to measure the print image on the web as shown in FIG. 1B. Alternately, the color measurement device 138 may be offline so as to measure the print image after printing.

The color portions of the print image on web 104 may be, for example, color control patches which are printed along the edge of the web, between impressions, in a location that is cut and discarded from the final product, or in an unobtrusive location on the final product. Alternately, the color portions of the print image on web 104 may be a preselected portion of the printed work, for example, a corporate logo.

The impression monitoring device 136 is configured to include and/or be in communication with a computer 132 to utilize the information captured by device 136. The computer 132 may be of the conventional type such as including a microprocessor and PC architecture. The computer 132 can include random access memory 133 (semiconductor memory and/or disk drive storage) and image monitoring circuitry 148 which interfaces with the impression monitoring device 136. In other embodiments, the computer 132 may be a microprocessor housed within the impression monitoring device 136.

The present system and method may be used for a variety of print applications, such as in the packaging industry, commercial printing, specialized printing, etc. The system and method may further be used for printing on films such as lamination film, paper, cardboard, labels, decorative films, or any other substrate in any form.

Figure 2:
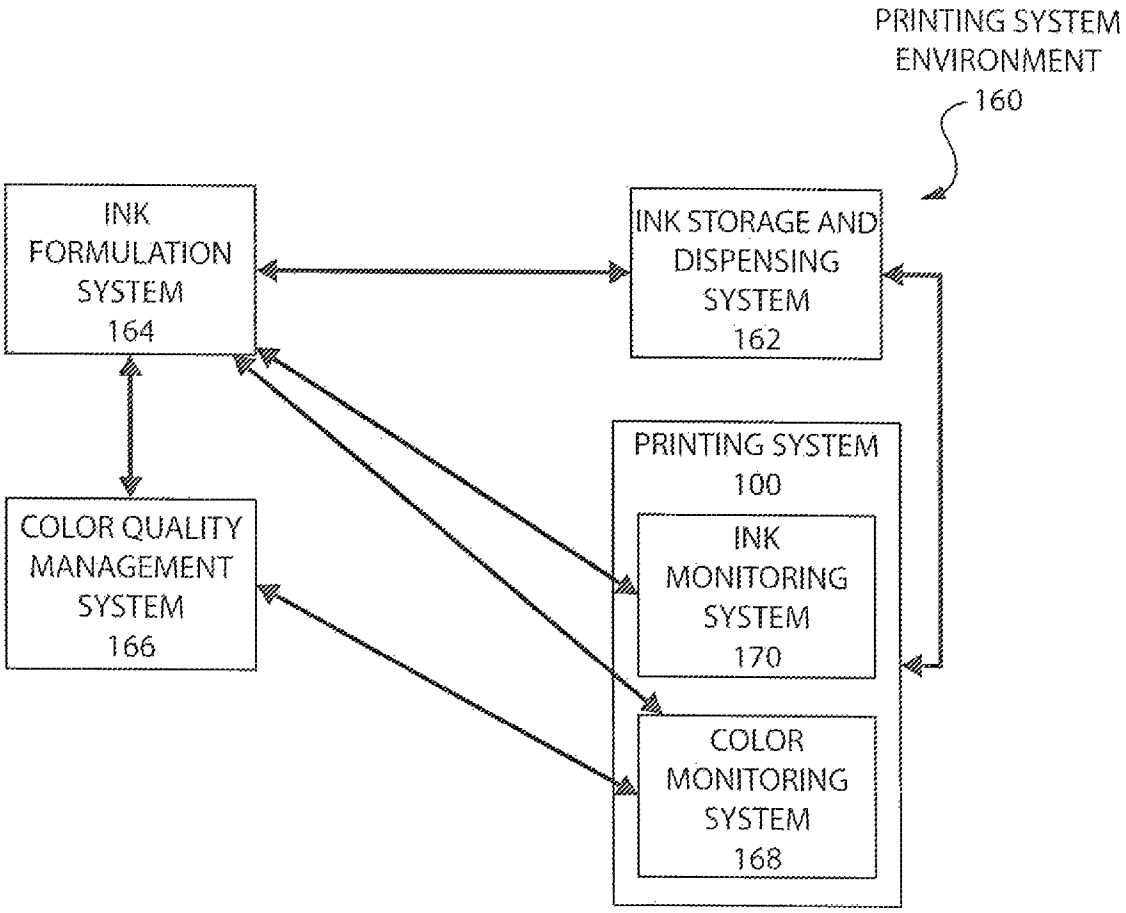
FIG. 2 is a block diagram illustrating a print system for monitoring ink utilization based on printed image information, according to an exemplary embodiment.

Referring now also to FIG. 2, a block diagram illustrating a print system 160 for tracking ink utilization based on printed image information is shown, according to an exemplary embodiment. Print system 160 includes the press system 100 of FIGS. 1A and 1B, shown here in block form, an ink storage/dispensing system 162, an ink formulation system 164, and a color quality management system 166. Press system 100 is further configured to include a color monitoring system 168 and an ink monitoring system 170, stored in memory 133 and executed by the computer 132.

Ink storage/dispensing system 162 may include one or more ink storage containers, also referred to as ink reservoirs, and associated dispensing systems configured to provide ink to print units, such as units 108A-D, shown in FIG. 1, as needed. The size of the ink storage containers and the type of dispensing system can vary widely based on a number of factors such as the size of the printing operation, the type of ink being dispensed, the printed image count of print material being generated, etc. Similarly, the selection of dispensing systems can also vary based on a number of factors. The dispensing system will typically include pumps that pump ink to the print units 108A-1), such as pneumatically operated pumps.

Ink storage/dispensing system 162 includes at least one ink reservoir (for black and white printing), may include four ink reservoirs, but more typically will include at least six ink reservoirs, one for each of colors black (K), cyan (C), magenta (M), and yellow (Y) along with two specialty colors. The size of each ink reservoir is dependent on the type of print system and anticipated number of images being printed. For example, for larger operations, the ink reservoirs may be large enough to hold several hundred kilograms of ink. For more typical operations, the ink reservoirs are sized to hold at least five kilograms of a particular color of ink although the system and method described herein can be used with any size.

According to an exemplary embodiment, each ink reservoir is a sealed container that is filled from a fill valve and dispensed using the dispensing system described above. In this embodiment, the ink inside the tank may be subjected to vacuum pressure to avoid introduction of air bubbles and/or other impurities to the ink stored in the ink reservoir.

Ink formulation system 164 is a computer system configured to generate an ink formulation for each color indicated in the print image information such as spectral reflectance values, color values (CIELAB), and color, surface roughness and opacity of the substrate, etc. The ink formulation may be used in combination with an ink ingredient dosing system to generate specific ink colors, ink density, etc. The ink formulation system 164 can calculate an ink recipe describing amounts of pigments to be added to generate a particular ink color. The ink formulation system may further require the addition of specific amounts of solvents, extenders, or other additives to produce the desired ink.

Color quality management system 166 may be a computer system that is configured to provide the ink characteristics including color to the ink formulation system 164.

Color quality management system 166 controls the specification of the inks to be used by the print system 100 based on print image information. The color specifications are provided to the ink formulation system 164 so that system 164 can determine the ink recipes that are needed to produce a printed image represented by the print image information. The specific ink recipes are supplied by the ink formulation system 164, and may be communicated to an ink ingredient dosing system 162 for automatic dispensing.

Ink formulation system 164 may also be used to correct any differences between the color targets and the actual color of the ink when applied to the substrate as detected by color measurement device 138, shown in FIG. 1B, and communicated by the color monitoring system 168, described below. Information on the actual color compared to the color target is used to calculate a recipe for correcting the color in the ink reservoir such that the color of the printed image matches the color target. In order to determine the amount of corrective ink composition to be added to the ink reservoir, it is necessary to know the amount of ink that is present in the ink reservoir. Accordingly, system 166 is configured to receive a current ink reservoir amount from the ink monitoring system 170, also described below, upon detecting any deviation between the color target and the color of the applied printed image.

Figure 3:
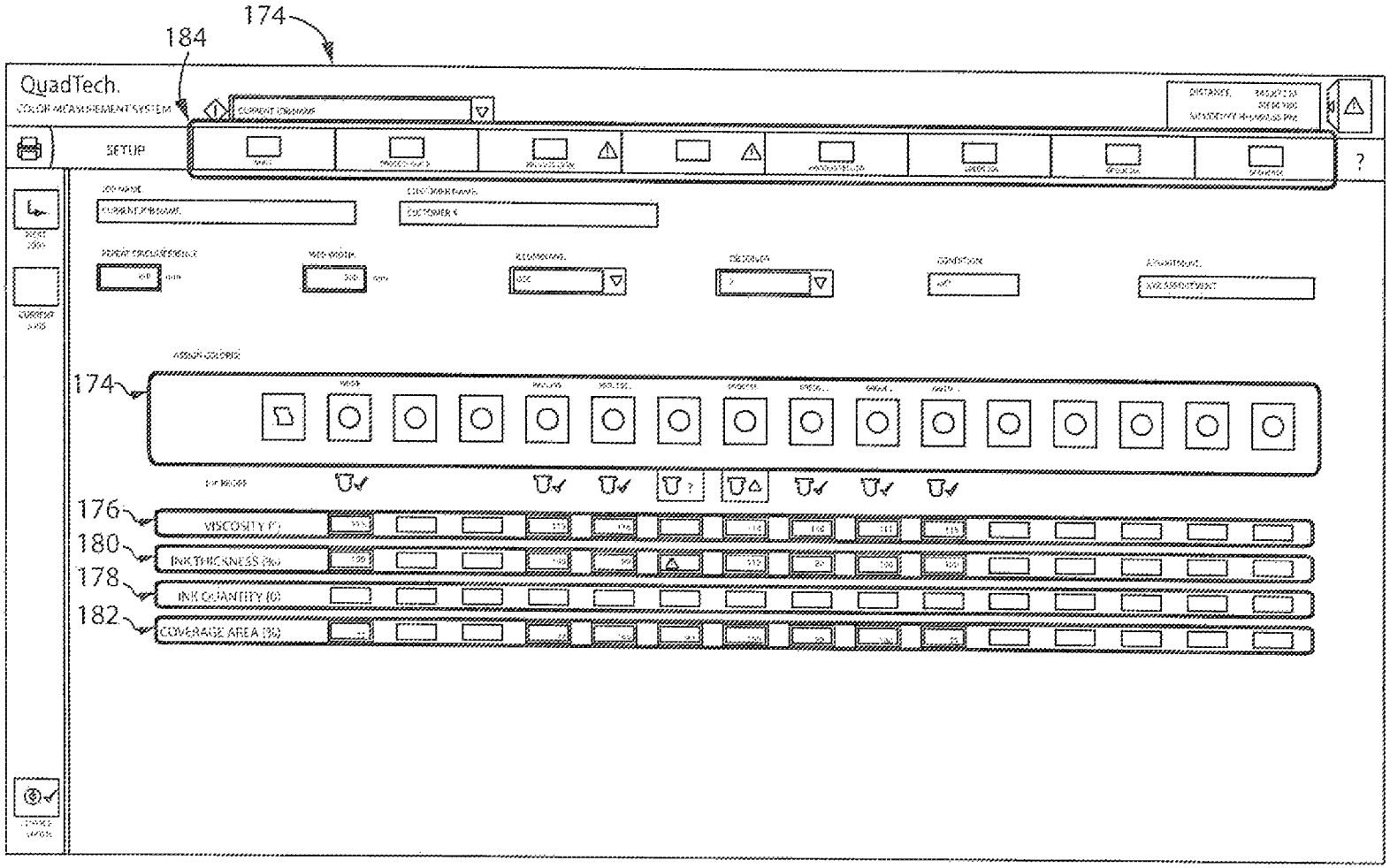
FIG. 3 is a representation of a color quality management interface configured to allow a user to configure ink color characteristics for each print unit in the print system of FIG. 1, according to an exemplary embodiment.

Referring now to FIG. 3, a color quality management interface 172 configured to allow a user to configure ink color characteristics for each print unit 108A-D in the press system 100 is shown, according to an exemplary embodiment. Accordingly, interface 172 is configured to display an ink color selection icon 174, an ink viscosity selection icon 176, an ink weight selection icon 178, an ink film thickness selection icon 180, and an area coverage selection icon 182.

According to an alternative embodiment (not shown), interface 172 may be configured to display ink availability information. The ink availability information may be displayed in a variety of ways including ink quantity, remaining run time based on print image information and ink utilization, and/or any other indication utilizing the ink amounts calculated as described herein. Interface 172 may further be configured to display warning messages based on the ink availability information if, for example, the amount of available ink will not be sufficient to complete the print job being monitored, if a new print job is being entered that will require more ink than is available, etc.

Interface 172 may be preloaded with initial settings based on received print image information. The initial settings may be determined based on printed image information received from a customer, based on a scanning of an exemplary image using image capture circuitry 148, based on information manually entered by user, based on analysis of a sample image using a variety of measurements such as weighing, scanning, etc.

Interface 172 further includes a print unit status display area 184 configured to show the status for each print unit. Interface 172, in the example shown, shows a print system that includes eight active print units, with the ability to add eight additional print units. As shown in FIG. 3, interface 172 has received the selection of the ink color for each of the active print units such that the ink color status for each of the active units is shown in display area 184. Although interface 172 currently depicts a status icon for each of the print units, display area 184 may alternatively display detailed settings information and/or include an interactive interface allowing the user to customize the settings for each print unit.

The interface 172 may be used to set specific color information for each print unit including, but not limited to, information such as viscosity targets, weights, ink film thickness, and/or area coverage based on the print image information. The specific color information may be determinative in calculating the amount of each color of ink that will be required to generate each printed image.

Referring again to FIG. 2, following configuration of the print units through interface 172, color quality management system 166 is configured to generate color information transmitted to both of ink formulation system 164 and color monitoring system 168. According to an exemplary embodiment, the generated color information may be transmitted in a color exchange format (.ext) file, as is known in the art, or any other format.

Color monitoring system 168 is configured to receive color target information from color quality management system 166 and determine whether colors in an applied print image printed on a substrate match the color target information. Accordingly, color management system 168 may be implemented in software stored in memory 133 and executed by computer 132 of press system 100. Color monitoring system 168 is configured to transmit a message to color quality management system 166 based on a detected deviation from the color target information.

Ink level monitoring system 170 is software configured to determine a current ink amount in each ink reservoir of the ink storage/dispensing system 162 based on the print image information received from color quality management system 166 and printed image count information detected by computer 132. The printed image count information may be a count of images, a determination of overall printed length, or any other determination of the amount of printed material being generated. This process may be performed on demand or continuously. Ink level monitoring system 170 may also be implemented as software stored in memory 133 and executed by the processor of computer system 132. Alternatively, any of the described functionality may be performed using hardware components.

Figure 4:
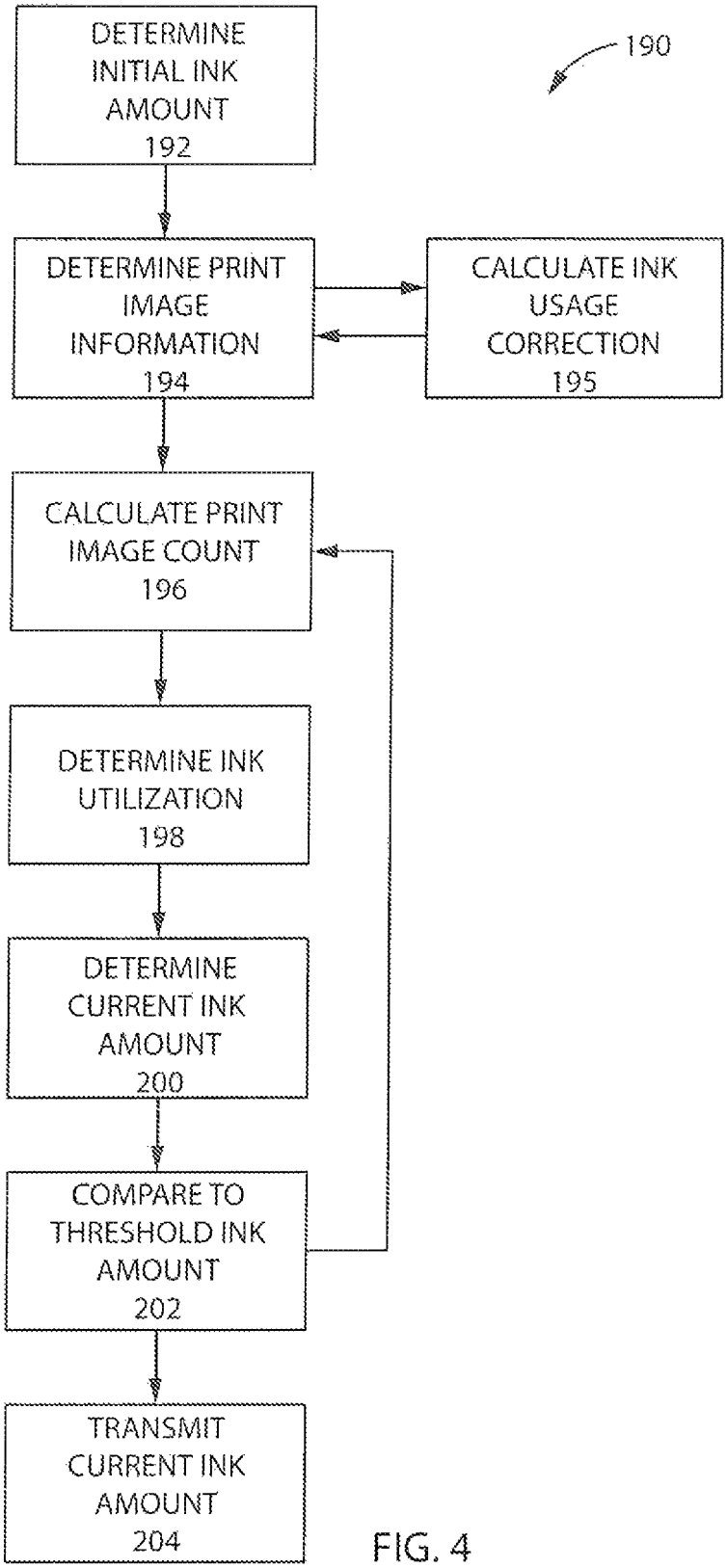
FIG. 4 is a flowchart illustrating a method for determining a current ink amount in each ink, reservoir based on the printed image information and printed image count information, according to an exemplary embodiment.

Referring now to FIG. 4, a flowchart 190 illustrating a method for determining a current ink amount in each ink reservoir based on the print image information and printed image count information is shown, according to an exemplary embodiment. The steps depicted in flowchart 190 are implemented by press system 100 in communication with the components in the press system 100. Is important to recognize that although flowchart 190 depicts specific steps and show these steps being performed in a specific order, the method may be implemented using more, fewer, and/or a different configuration of steps to implement the functionality described herein.

In a step 192, ink level monitoring system 170 is configured to receive an initial ink amount. The initial ink amount may be determined using any of a variety of methods. For example, a user adding a five kilogram drum of ink to an empty ink reservoir can manually enter five kilograms as an initial ink amount using a computer keyboard. Alternatively, where ink is being added to a non-empty ink reservoir, the ink reservoir may be weighed using a scale either after the ink has been added or before adding a known amount, as described above. Advantageously, following the initial weighing, ink level monitoring system 170 may be used to avoid, or minimize the need for additional weighing requiring additional manpower and interrupting ink availability.

After determining the initial ink amount, system 170 is configured to receive print image information including an ink amount used in printing a print image on a substrate in a step 194. The ink amount may be for a single color, such as for a black and white image, or a plurality of colors, such as for a color image. The amount of ink used in an image may be determined based on a formula for calculating the amount of ink being used:

$$Q=C*W*L*G$$

where C is the percentage of area covered by ink, W is the width of the web 104, L is the length of the printed web, and C is ink utilization of a solid ink on the substrate of the printed material, represented in $g/m^2$. C may be determined from the print image information, for example from the digital plate files, and is dependent on the amount of a particular color being used in each image. L may be determined based on the number of printed images (e.g., a printed image count representing one or more instances of a printed image for a given length), counts on an encoder, detection of eye marks (a typically black fiducial mark used to trigger converting processes downstream of the printing process), etc. G may be determined based on a printed test sheet that is weighed and/or otherwise measured using conventional techniques to determine the weight of the substrate 104 including a printed image. For example, G may be determined by weighing a small section of the substrate after applying ink to a substrate by printing or implementing a drawdown, cleaning the ink from the substrate, drying the substrate, and then reweighing the processed substrate.

Accordingly, system 170 can determine, based on information received from color quality management system 166 and/or information manually entered by an operator, color measurements of a representation of the printed image on a substrate and one or more values detected during printing. Using this information, system 170 can determine the amount of each color of ink that will be used during a print operation.

In one exemplary embodiment, the calculation of the ink utilization may be refined by applying a correction K if there is a difference between the measured dry ink utilization in a dried print image and the amount of wet ink required to generate the measured dry ink. In accordance with the exemplary embodiment, the amount of wet ink used in an image may be determined based on a revised formula for calculating the amount of ink being used:

$$Q=C*W*L*G*K$$

where K is be determined, for example, by comparing the weight of the ink used in a drawdown to the final dried weight. In a step 195, ink usage may further include applying an ink usage correction by characterizing a print condition of a printed image as applied to the substrate to determine an ink usage correction multiplier. Characterizing the print condition can include determining and/or calculating any effect on the amount of wet ink utilized to produce a dry ink image including, but not limited to, determining a dry ink coverage, a dry ink thickness, ink properties, and substrate properties for a printed image. The amount of wet ink that is used in generating the printed image can be determined based on the characterization of the print condition.

According to an exemplary embodiment, characterizing the print condition may include performing one or more ink usage corrections based on a known difference between as determined print condition for dry ink and a wet ink usage known to result in the determined print condition. The difference may be used to generate the ink usage correction multiplier that is applied to the measured values to calculate the wet ink usage that would result in the measured values.

According to a first example, for a determined dry ink, thickness, the amount of wet ink that is used to produce that thickness may be greater than the thickness of the dry ink over the coverage area based on the determined substrate properties. For example, a dry ink thickness on a film substrate that allows almost no wet ink absorption will be greater than the dry ink thickness on substrates that will absorb at least some of the wet ink prior to drying.

According to a second example, for a determined ink thickness, the amount of ink that is used to produce that thickness may be greater than the thickness over the coverage area dependent on the amount of ink drying that has occurred. In some instances the amount of ink used to generate a dried ink thickness can be empirically determined and used to generate an ink usage correction multiplier that is multiplied by the ink thickness to determine ink usage. Alternatively, the amount of ink used to generate a dried ink thickness can be calculated based on a known solvent percentage of components in the ink being characterized.

In some instances, the amount of wet ink used to generate a dried ink thickness can be theoretically determined by subtracting the weight of the solvent that was added to the ink. This theoretical approach may, however, lead to unacceptably large errors, since it assumes that all the solvents will evaporate, and that none of the other components will evaporate. In addition, this theoretical approach does not take into account the amount of solvents that are already in the ink as it is delivered to the print site.

Following the determination of the amount of ink that is used for each print image, system 170 is configured to determine a printed length, for example by calculating a printed image count information representing the number of instances that the print image is being printed by press system 100 in a step 196. The printed length may be determined in a variety of ways including, but not limited to, counting a number of fiducial marks, which may be printed on each impression, tabulating an amount of end product generated that includes the printed image, determining the linear measurement of substrate that has been printed upon, etc.

In a step 198, an ink utilization value is determined based on the amount of ink used per print image as calculated in step 194, as corrected in step 195 if needed, and the number of times that the image has been printed as calculated in step 196. The ink utilization value may be represented in a number of different ways. For example, the ink utilization rate may be a number representing the amount of ink that has been used since the last time ink was added to the reservoir and the initial ink amount was set in step 192, the ink utilization value may be an ink consumption rate that can be used to project the amount of ink that will be used over any particular time period, etc.

In a step 200, the ink utilization value is used in combination with the initial ink amount to determine ink availability information. In its simplest form, where an ink utilization value is the amount of ink that has been used since the initial ink amount was set, the current ink amount may be obtained by subtracting the ink utilization value from the initial ink amount. Alternatively, the ink utilization value may be used to determine the ink availability information, the amount of printing time that remains based on the ink utilization value where the value is a consumption rate, etc.

In a step 202, the current ink amount is compared to a minimum ink availability threshold to determine whether additional ink is needed. The threshold may be a fixed value, for example one kilogram, such that the operator is alerted when only a relatively small amount of ink is remaining. The threshold value may alternatively be based on a remaining print time at the current print value, may be dependent on the printed image count remaining in a particular print job, etc. If the current ink amount is above the threshold value, the printed image count is monitored again in step 196 in a monitoring loop.

If the current ink amount is below the threshold value, print system 10 is configured to recognize that additional ink is needed. The amount of ink that is needed and the particular formulation of that ink may depend on the current ink amount. Accordingly, system 170 is configured to transmit the current ink amount to the color quality management system in a step 204. This information may be used to display ink amounts, warning messages, etc. as described above with reference to interface 174.

Additionally, the color monitoring system 168 is configured to monitor the printed images as described above with reference to FIG. 2. Based on the monitored images, system 168 is configured to determine whether the color of the printed images matches the target colors. If the color discrepancy is outside of a tolerance range, color monitoring system 168 is configured to transmit a color discrepancy report to ink formulation system 164. In addition, ink monitoring system 170 will provide the current ink quantity to ink formulation system 164, so that the correct current ink quantity may be used during the calculation of the ink recipe correction.

In some instances, a color discrepancy may be attributable to an improper formulation of ink. In other instances, a color discrepancy may be attributable to a print unit that provides an ink transfer different from the anticipated amount, for example as the result of a difference in roller pressure or in ink viscosity. In this second instance, the calculation of ink usage may represent the amount of ink that was expected to have been utilized rather than the amount of ink that was actually utilized.

Thus, it may be advantageous to provide an additional correction, according to a third embodiment of the ink utilization equation:

$$Q=C*W*L*G*K*T$$

where T is the transfer correction, which accounts for a difference in ink transfer. The value of T may be expressed as the ratio of actual ink transfer to expected ink transfer. These values may be determined through the use of the color measurement device 138, which provides color measurements to the ink formulation system 164. The ink formulation system 164 may then determine a change in pigment concentration that would produce the required color change. If it is determined, either automatically or through user intervention, that the cause of the color discrepancy is due to ink transfer rather than incorrect ink formulation, then the change in concentration may be used to determine the value of the transfer correction T.

Alternately, if the color monitoring system 168 determines that there is a large discrepancy between the color targets and the actual color of the ink when applied to the substrate, the user may be provided with an indication that the reported ink utilization and/or ink availability may not be accurate.

It should be understood that the present invention is not limited to the particular exemplary applications and embodiments illustrated and described herein, but it embraces such modified forms thereof as come within the scope of the following claims. For example, ink amount has been expressed in the examples herein as a mass in kilograms. It should be apparent to anyone skilled in the art that an ink amount can be expressed in terms of other physical properties, for example, in terms of weight or of volume. Further, it should be noted that the present invention is not limited to particular methods and a system for utilizing the current ink amount that is generated using printed image information.

We claim:

1. A computer-implemented system for determining ink utilization in a printing system, comprising:

an ink monitoring computer including a processor and non-transient memory including instructions stored thereon to determine ink utilization in an ink reservoir based on receiving a characterization of a print condition to determine dry ink utilization per area of coverage at a printing system computer;

applying an ink usage correction multiplier to determine wet ink utilization based on the dry ink utilization to generate corrected image ink utilization;

determining an area of coverage for a given printed image;

determining printed image count information including a number of printings of the given printed image; and determining total wet ink utilization based on the area of coverage, the corrected image ink utilization and the printed image count information.

2. The computer-implemented system of claim 1, wherein the ink usage correction multiplier is determined based on the formulation of the specific ink being printed.

3. The computer-implemented system of claim 1, wherein determining the print image count information includes receiving a print image count value from a device monitoring the print system.

4. The computer-implemented system of claim 1, wherein the ink usage correction multiplier is determined based on the formulation of a specific ink being printed in combination with a specific substrate receiving the printed image.

5. The computer-implemented system of claim 4, wherein the ink usage correction multiplier is determined by characterizing a print condition of the print image following application of the specific ink to the substrate.

6. The computer-implemented system of claim 5, wherein characterizing the print condition includes determining an amount of wet ink used to produce dry ink as applied to the substrate.

7. The computer-implemented system of claim 1, where the ink monitoring system is further configured for receiving an initial ink amount, and utilizing the initial ink amount and the ink utilization to determine an ink availability.

8. The computer-implemented system of claim 7, where the ink monitoring system is further configured for comparing the ink availability to a minimum ink availability threshold.

9. The computer-implemented system of claim 7, where the ink monitoring system is further configured for receiving an actual color and a target color, calculating a recipe for correcting the color utilizing the ink availability, and determining the amount of a corrective ink composition to be added.

10. The computer-implemented system of claim 1, where the ink monitoring system is further configured for receiving an actual color and a target color and determining a discrepancy between the actual color and the target color, wherein the ink usage correction multiplier is determined based on a comparison between the actual color of the printed image and the corresponding target color.

11. The computer-implemented system of claim 1, where the ink monitoring system is further configured for receiving an actual color and a target color, determining a discrepancy between the actual color and the target color, and determining the ink usage correction multiplier based on a comparison between the measured color of the printed image and the corresponding target color.

* * * * *